United States Patent [19]

Ytter

[11] 4,436,135

[45] Mar. 13, 1984

[54] PORTABLE DISPLAY SYSTEM

[75] Inventor: Willy Ytter, Stockholm, Sweden

[73] Assignee: Extraversion, Inc., New York, N.Y.

[21] Appl. No.: 116,102

[22] Filed: Jan. 28, 1980

[51] Int. Cl.[3] ..... A47G 5/00

[52] U.S. Cl. ..... 160/135; 160/232; 160/234; 160/381

[58] Field of Search ..... 160/135, 229 R, 232, 160/234, 381; 248/174; 52/580, 71, 239, 589

[56] References Cited

U.S. PATENT DOCUMENTS

| | | | |
|---|---|---|---|
| 1,282,685 | 10/1918 | Goldhahn | 160/135 X |
| 3,300,899 | 1/1967 | Haws et al. | 52/580 X |
| 3,312,032 | 4/1967 | Ames | 52/580 |
| 3,341,992 | 9/1967 | Piper | 52/580 X |
| 3,768,222 | 10/1973 | Birum | 160/135 X |
| 3,803,787 | 4/1974 | Daggy | 52/580 |
| 4,060,294 | 11/1977 | Haworth et al. | 160/135 X |
| 4,147,198 | 4/1979 | Ytter | 160/135 |

*Primary Examiner*—Rodney H. Bonck

*Attorney, Agent, or Firm*—Wolf, Greenfield & Sacks

[57] ABSTRACT

A portable display system having a plurality of hollow panel assemblies with each comprising two parallel and facing wall boards secured within a border strip device. Eight panel assemblies are hinged together to fold and unfold between a folded position in which all panel assemblies are in parallel stacked relation and an unfolded position in which the panels are open in any one of a number of different positions including a continuous wall arrangement.

11 Claims, 4 Drawing Figures

PORTABLE DISPLAY SYSTEM

BACKGROUND OF THE INVENTION

The present invention relates in general to a portable display system, and more particularly, a display system that is relatively easy to set up and which lends itself readily to large display requirements.

Among the objects of this invention is to provide a display system wherein the display panels are hinged together so that they may be opened and closed into various different display configurations.

Another object of the present invention is to provide a versatile display system which can be formed in displays of various sizes and configurations and yet which is readily portable. The display of the present invention preferably employs lightweight wallboards secured by border strip means.

Another object of the present invention is to provide border strip means of improved construction.

Still another object of the present invention is to provide an improved portable display system having means of relatively simple construction for interlocking adjacent panel assemblies.

Still another object of the present invention is to provide an improved portable display system having an improved hinging arrangement.

Reference is also made herein to my earlier U.S. Pat. No. 4,147,198 which shows a portable display system. This patent also refers to other references of general pertinence to the field of this invention.

SUMMARY OF THE INVENTION

According to the invention, there is provided a portable display system which comprises a plurality of panel assemblies, each comprising detachable removable front and rear panels preferably constructed of a wall board or the like, and border strip means which preferably comprise two basic types of border strips, namely, first and second peripheral support members for supporting and positioning the detachable panels in a substantially parallel and confronting relationship. The first peripheral support means preferably includes a fixed member and an outer removable member which is removable for the purpose of removing one or both panels. This first peripheral support means is positioned along at least one outer edge of the detachable front and rear panels. The second peripheral support means is positioned along the other edges of these panels. The display system also includes hinge means for interconnecting the plurality of panel assemblies with said panel assemblies being divided into first and second array. In the disclosed embodiment, each array comprises four panels, however, in a smaller embodiment, each array could comprise two or three panels. Each of these arrays include a main panel assembly and at least one other connected panel assembly. The hinge means comprises at least first and second pairs of side hinges and a pair of corner hinges. Means are provided for securing the first pair of side hinges to side disposed second peripheral support means of adjacent panel assemblies of the first array. Similarly, means are provided securing the second pair of side hinges to side disposed second peripheral support means of adjacent panel assemblies of the second array. Means are also provided securing the pair of corner hinges between main panel assemblies of the first and second arrays with one of the corner hinges disposed along said side disposed second peripheral support means of first and second array main panel assemblies. The other of said corner hinges is disposed along the opposite side disposed second peripheral support means of the first and second array main panel assemblies.

In accordance with another aspect of the present invention there is provided for a portable display system having a plurality of panel assemblies, an improved border strip means for supporting each panel comprising first peripheral support means including a fixed member and an outer removable member engageable with the fixed member, and second peripheral support means positioned along the other edges of said panel. The removable members of facing panel assemblies are provided with registration means which is preferably in the form of a tongue and groove arrangement to maintain the panel assemblies in planar relationship. Furthermore, in order to provide a proper alignment of the tongue and groove arrangements, the removable members are preferably keyed for only single position interconnection with its corresponding fixed member.

In accordance with the present invention the portable display system is arranged so that the panel assemblies may be hinged together to be opened and closed into various display configurations including the one disclosed herein. When in an entirely closed position, the entire display case is similar in appearance to a suitcase and affords the use of a highly portable display device. When fully opened, in the disclosed embodiment the display system may be provided in an eight panel arrangement.

BRIEF DESCRIPTION OF THE DRAWINGS

Numerous other objects, features and advantages of the invention should now become apparent upon a reading of the following detailed description taken in conjunction with the accompanying drawings, in which.

DETAILED DESCRIPTION

Figure 1:
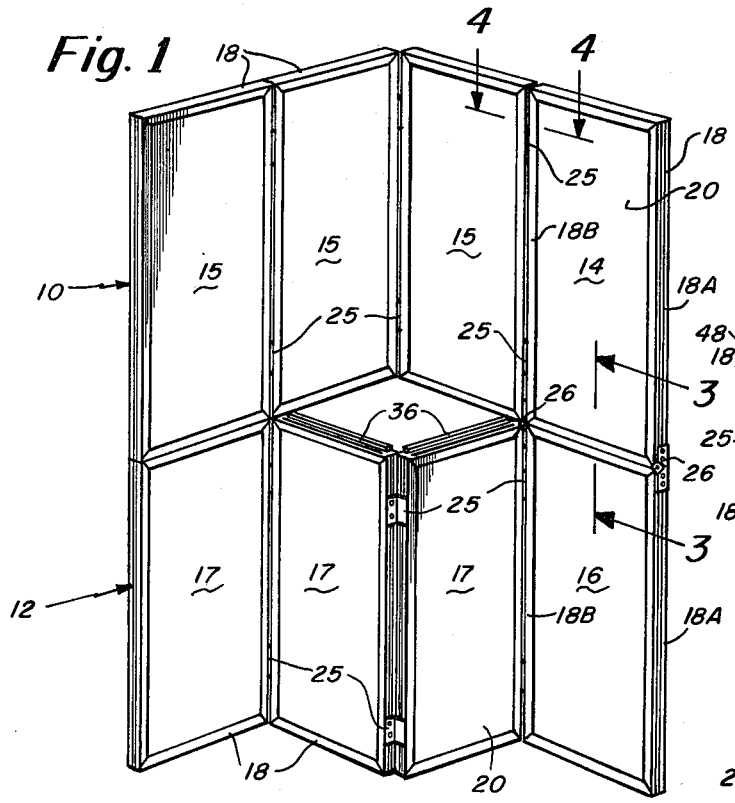
FIG. 1 is a perspective view showing the entire portable display system in an embodiment having eight total panel assemblies, being arranged in a typical display configuration.
Figure 4:
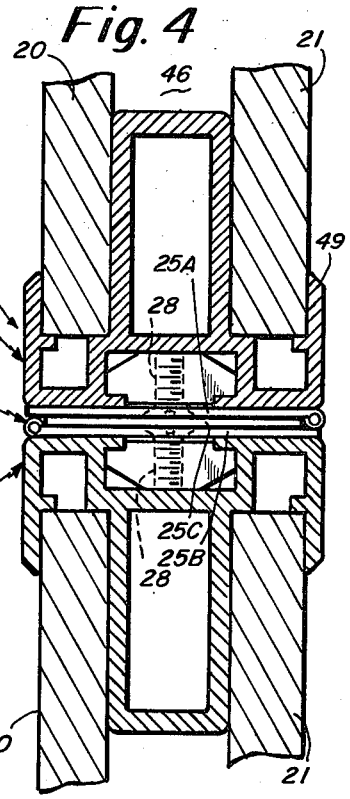
FIG. 4 is another cross-sectional view taken along line 4—4 of FIG. 1 showing the further detail of the other type of border strip device that is employed.
Figure 3:
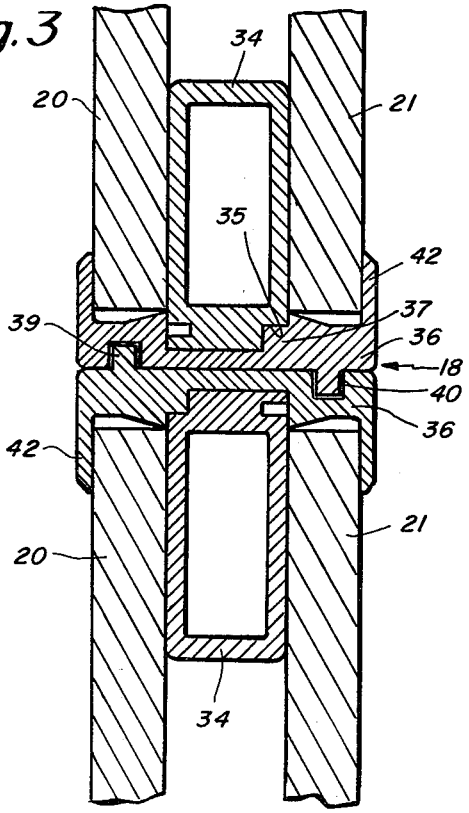
FIG. 3 is a cross-sectional view showing the detail of one type of the border strip means taken along line 3—3 of FIG. 1.
Figure 2:
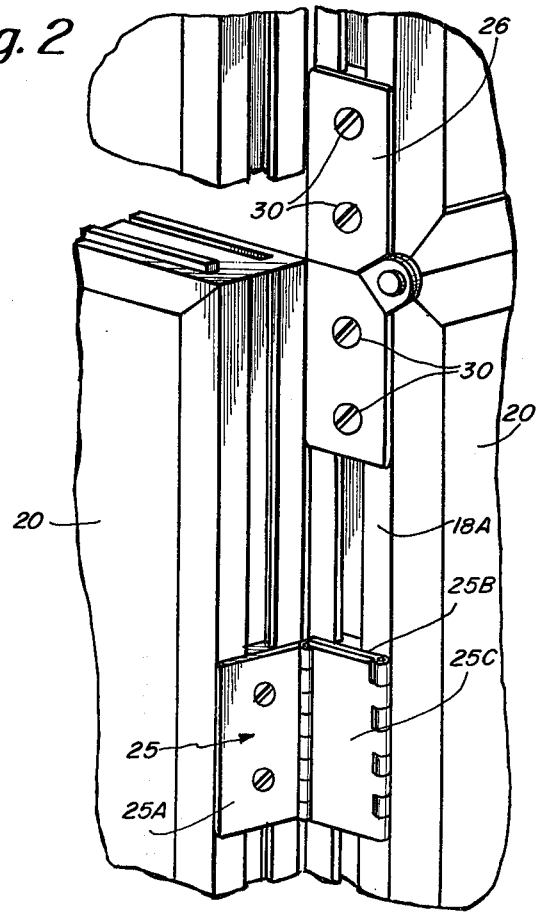
FIG. 2 is an enlarged fragmentary perspective view showing further detail of the hinging arrangement disclosing both a corner hinge and a double hinge.

Referring now to the drawings, there is shown, in FIG. 1 a portable display system in accordance with the present invention. FIGS. 2–4 show further details of construction particularly with regard to the border strip means that is employed in the invention. The display system comprises a plurality of panel assemblies separated into an upper array 10 and a lower array 12. Each of these arrays comprises four separate panel assemblies. The upper array 10 includes a main panel assembly 14, and three other connected panel assemblies 15. Similarly, the lower array includes a main panel assembly 16 and three other interconnected panel assemblies 17. Each of the panel assemblies comprises a rectangular frame 18 also referred to herein as a border strip device, and a pair of parallel confronting panels or wallboards 20 and 21.

The main panel assembly 14 has the next adjacent section 15 hinged thereto by means of a suitable double hinge 25. Other similar hinges are employed to hinge the remaining panel assemblies 15 adjacent to each other. Further details of the double hinge are depicted in FIGS. 2 and 4. Similarly, the main panel assembly 16 of array 12 has the next adjacent section 17 hinged thereto by means of the same type of double hinge 25. Also, the remaining sections 17 are hinged in succession by means of such a double hinge 25. This double hinge arrangement permits essentially two-way hinging as depicted in the middle two assemblies of each array 10 and 12 of FIG. 1. Two hinges are employed between each panel assembly although in an alternate embodiment more than two hinges could be employed.

In addition to the double hinges 25 that are used between panel assemblies in each array, there are also provided two corner hinges 26. These corner hinges 26 are disposed on opposite sides of the main panel assemblies 14, 16. Thus, one of the hinges 26 connects between border strips 18A of panel assemblies 14 and 16 while the other corner hinge 26 extends between border strips 18B of main panel assemblies 14 and 16. FIG. 2 shows also the corner hinge 26 on one side of the main panel assemblies.

With the arrangement depicted in FIG. 1, the entire upper array 10 can be pivoted relative to the lower array 12 by means of the two corner hinges 26. The remaining panel assemblies are not hinged between arrays, but instead are interlocked into position by means of an interlocking or registration technique described hereinafter.

FIGS. 2 and 4 show the double hinges 25 which include outer hinge plates 25A and 25B and intermediate hinge plate 25C. This hinge may be of the type described in my previous U.S. Pat. No. 4,147,198. As depicted in the drawing, the hinge is attached by bolts or screws 28 which pass through the hinge and into the border strip means 18. Similarly, the corner hinge 26 may be of the type described in my U.S. Pat. No. 4,147,198 with screws or bolts 30 being provided for securing the corner hinge to the respective border strip means.

As depicted in the drawings, there are basically two different border strip arrangements depicted respectively in FIGS. 3 and 4. The first of these peripheral support means is shown in FIG. 3 comprising a fixed member 34 that is preferably hollow, as shown, and a removable member 36 that is adapted to snap fit with the fixed member 34. The members 34 and 36 are adapted to be interconnected in only one of two possible positions by means of a keying arrangement including a slot 35 at one corner of the fixed member cooperating with a shoulder 37 of the removable member 36. Each of the removable members also includes a tongue and groove arrangement including tongue 39 and groove 40. The keying arrangement including the slot 35 and the shoulder 37 prevents misalignment between the tongue and groove arrangement of one member 36 which is adapted to interlock with an adjacent member 36. FIG. 3 shows the correct position. However, if one of the members 36 was snap-fitted in an opposite direction, then the tongues and grooves would not line up but instead a tongue would line up with a tongue and a groove with a groove which is not desired.

When the removable outer member 36 is disengaged from the fixed member 34 the overall panel assembly stays intact. This may be accomplished in the same manner as in the construction of my prior art patent such as by the use of a corner locking device inserted within the hollow of member 34.

The tongue and groove interlock arrangement extends along each removable member a distance less than the length of the removable member as illustrated in FIGS. 1 and 2 leaving interlock free ends that enable corresponding ones of the panel assemblies of the adjacent arrays to be maintained folded as illustrated in FIG. 1, out of interlock relationship, while the main panel assemblies 14 and 16 are interlocked as also illustrated in FIG. 1. The interlock means extend at least in part out of the outer surface of the removable member such as illustrated in FIGS. 2 and 3.

Between the member 34 and walls 42 of the member 36 there is defined a channel for receiving the panels 20, 21. However, when the member 36 is disengaged from the fixed member 34, then the panels 20 and 21 are free to be withdrawn from the display system. In the disclosed embodiment of FIG. 1, this first type of border strip, including a removable section is provided only at the interface between the upper and lower arrays. Thus, the tongue and groove interlocking arrangement occurs between each of the panel assemblies 15 and 17 and also between the panel assemblies 14 and 16. The remaining border strip means may all be of the type depicted in FIG. 4 wherein the entire border strip is of the fixed type particularly, where the hinges 25 are fastened. A border strip device as depicted in FIG. 4 is used.

In FIG. 4 the border strip device includes an inner member 46 integral with an outer section 48. The inner member 46 is similar to member 34 in that it is hollow and forms the means by which different linear sections of the border strip are interconnected by means of a corner locking device not shown in the drawings. This locking device as previously mentioned may be of the type shown in my previous U.S. Pat. No. 4,147,198. The outer section 48 includes walls 49 defining with the inner member 46 oppositely disposed channels for the panels 20 and 21. The border strip device shown in FIG. 4 may be employed in the embodiment of FIG. 1 on all vertical portions of the frames of the panel assemblies. Also, this form of a border strip device may be used at the bottom of the frame in array 12 and at the top of the frame in array 10.

What is claimed is:

1. A portable display system comprising:

a plurality of panel assemblies each comprising a detachable front panel and a detachable rear panel, and border strip means including at least first and second peripheral support members for supporting and positioning the detachable panels in a substantially parallel and confronting relationship;

said first peripheral support means at least partially removably positioned along at least one outer edge of said detachable front and rear panels, said second peripheral support means positioned along the other edges of said detachable front and rear panels;

hinge means for interconnecting the plurality of panel assemblies with said panel assemblies being divided into first and second arrays;

said arrays each including a main panel assembly and at least one other connected panel assembly;

said hinge means comprising at least first and second pairs of side hinges and a pair of corner hinges, means securing said first pair of side hinges to side disposed second peripheral support means of adjacent panel assemblies of the first array;

means securing said second pair of side hinges to side disposed second peripheral support means of adjacent panel assemblies of the second array;

means securing said pair of corner hinges between main panel assemblies of first and second arrays with one of said corner hinges disposed along said side disposed second peripheral support means of first and second array main panel assemblies, and the other of said corner hinges disposed along opposite side disposed second peripheral support means of first and second array main panel assemblies.

2. A portable display system as set forth in claim 1 wherein said first peripheral support means includes a fixed member and an outer removable member, the facing border strip means of first and second arrays being first peripheral support means.

3. A portable display system as set forth in claim 2 wherein the facing removable members have interlocking means.

4. A portable display system as set forth in claim 3 wherein the interlocking means includes tongue and groove means.

5. A portable display system as set forth in claim 3 wherein said fixed and removable members are keyed for single direction interconnection.

6. A portable display system as set forth in claim 1 wherein the first peripheral support means includes a fixed member and an outer removable member, the facing border strip means of first and second arrays being first peripheral support means with their removable member having mating integral interlock means so that the first and second arrays are interlocked in a full open position of the system, one array overlying the other.

7. A portable display system as set forth in claim 6 wherein the interlock means extends along each removable member a distance less than the length of the removable member leaving interlock free ends that enable said at least one other connected panel assemblies of adjacent arrays to be maintained folded out of interlock relationship while the main panel assemblies of adjacent arrays are interlocked.

8. A portable display system as set forth in claim 7 wherein one of the corner hinges includes planar arranged hinge ends, one end fitted between adjacent panel assemblies of one array and the other end fitted between adjacent panel assemblies of the other array.

9. A portable display system as set forth in claim 7 wherein the interlock means extend at least in part out of the outer surface of the removable member.

10. A portable display system as set forth in claim 7 wherein the interlock means is provided between all panel assemblies of adjacent arrays.

11. A portable display system as set forth in claim 1 wherein the corner hinges are the only hinging connection between the first and second array assemblies.

* * * * *